US011109141B2

(12) United States Patent
Tews et al.

(10) Patent No.: US 11,109,141 B2
(45) Date of Patent: Aug. 31, 2021

(54) SEAMLESS PIVOT FOR HEAD-WORN AUDIO DEVICES

(71) Applicant: Plantronics, Inc., Santa Cruz, CA (US)

(72) Inventors: Erik Henry Tews, Santa Cruz, CA (US); John A Kelley, Santa Cruz, CA (US); Nicholas W Paterson, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 28 days.

(21) Appl. No.: 16/783,508

(22) Filed: Feb. 6, 2020

(65) Prior Publication Data

US 2020/0177985 A1 Jun. 4, 2020

Related U.S. Application Data

(63) Continuation of application No. 15/862,446, filed on Jan. 4, 2018, now Pat. No. 10,567,864.

(51) Int. Cl.
*H04R 1/10* (2006.01)
*H04R 5/033* (2006.01)

(52) U.S. Cl.
CPC ..... *H04R 1/1066* (2013.01); *H04R 1/1008* (2013.01); *H04R 1/1033* (2013.01); *H04R 1/1058* (2013.01); *H04R 1/1091* (2013.01); *H04R 5/0335* (2013.01); *H04R 1/105* (2013.01); *H04R 2201/107* (2013.01)

(58) Field of Classification Search
CPC .... H04R 1/1008; H04R 1/1016; H04R 1/105; H04R 1/1058; H04R 1/1066; H04R 5/0335; H04R 2201/107; H04R 1/1033; H04R 1/1091
USPC ..... 381/309, 370, 374, 376, 377, 378, 379, 381/383; 181/129; 2/209; 379/430
See application file for complete search history.

(56) References Cited

U.S. PATENT DOCUMENTS

| | | | | |
|---|---|---|---|---|
| 2,586,644 | A | 2/1952 | Gilbert | |
| 4,463,223 | A | 7/1984 | Yamanoi et al. | |
| 6,690,808 | B2 * | 2/2004 | Urwyler | H04R 1/1033 381/327 |
| 7,580,539 | B2 | 8/2009 | Tachikawa | |
| 9,522,086 | B2 * | 12/2016 | Jenkins | H04R 1/1066 |
| 9,544,688 | B1 | 1/2017 | Knoblock | |
| 10,567,864 | B2 * | 2/2020 | Tews | H04R 1/1033 |
| 2010/0296684 | A1 | 11/2010 | Eberl et al. | |

* cited by examiner

*Primary Examiner* — Huyen D Le
(74) *Attorney, Agent, or Firm* — Ferguson Braswell Fraser Kubasta PC

(57) ABSTRACT

The invention relates to a head-worn audio device having a first earcup, a second earcup, and a headband extending between the first earcup and the second earcup. The headband includes a spring member disposed along a longitudinal axis of the headband. The spring member has a first end and a second end. The headband also includes a first headband tube coupled to the first earcup and the first end of the spring member. Further, the headband includes a second headband tube coupled to the second earcup and the second end of the spring member. The first headband tube is configured to rotate around the first end of the spring member, and the second headband tube is configured to rotate around the second end of the spring member.

13 Claims, 7 Drawing Sheets

SEAMLESS PIVOT FOR HEAD-WORN AUDIO DEVICES

CROSS-REFERENCE TO RELATED APPLICATIONS

This application is a continuation of U.S. patent application Ser. No. 15/862,446 entitled "Seamless Pivot for Head-Worn Audio Devices," filed Jan. 4, 2018, the disclosure of which is incorporated by reference herein in its entirety as though set forth in full.

FIELD

The present disclosure relates generally to the field of head-worn audio devices. More particularly, the present disclosure relates to an earcup pivot for head-worn audio devices, such as headphones and headsets.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

Head-worn audio devices such as headphones traditionally include at least one pivoting joint somewhere between each speaker capsule and the headband. The pivoting joints of a head-worn audio device allow the audio device to conform to different sizes and shapes of heads, thereby ensuring a comfortable and proper fit for different users. In some instances, these pivoting joints allow the head-worn audio device to fold for storage when not in use. Often, these pivoting joints are externally accessible, such that one or more components of the pivoting joints are readily visible to users. For example, a pivoting arm or yoke may be externally visible. These designs may be generally referred to herein as external pivots. External pivots present numerous issues. First, external pivots can present difficulties for mass manufacture. For example, the components of external pivots often require special attention in order to obtain aesthetically acceptable color, materials, or finishing of these components. Second, external pivoting elements can pinch or pull the hair of a wearing user, causing the user pain and discomfort. Third, external pivots may be easily broken or damaged by a user during transport or when handled improperly. Fourth, external pivots may provide a route of ingress for environmental elements (e.g., dirt, dust, other debris, electrostatic discharge, etc.) to the electrical and mechanical components housed in an earcup. In other words, external pivots may increase the susceptibility of a head-worn audio device to environmental damage.

SUMMARY

In general, in one aspect, an embodiment features a seamless pivot for a head-worn audio device. The seamless pivot includes a headband tube configured for interconnecting an earcup and a headband of the head-worn audio device. The headband tube includes a channel extending from a top surface of the headband tube to an internal detent and an internal cavity of the headband tube. The seamless pivot also includes a spring member. A portion of the spring member is disposed within the channel of the headband tube and configured to allow rotation of the headband tube relative to the portion of the spring member. An end of the spring member terminates within at least one of the internal detent and the internal cavity of the headband tube. A range of the rotation of the headband tube, relative to the portion of the spring member within the channel, is limited by the internal detent of the headband tube.

In general, in one aspect, an embodiment features a head-worn audio device. The head-worn audio device includes a first earcup, a second earcup, and a headband extending between the first earcup and the second earcup. The headband includes a spring member disposed along a longitudinal axis of the headband. The spring member has a first end and a second end. Also, the headband includes a first headband tube coupled to the first earcup and the first end of the spring member. Further, the headband includes a second headband tube coupled to the second earcup and the second end of the spring member. The first headband tube is configured to rotate around the first end of the spring member, and the second headband tube is configured to rotate around the second end of the spring member.

In general, in one aspect, an embodiment features a head-worn audio device including an earcup and a headband extending from the earcup. The headband includes a spring member disposed along a longitudinal axis of the headband. The spring member has a first end and a second end. Also, the headband includes a headband tube coupled to the earcup and the first end of the spring member. The headband tube is configured to rotate around the first end of the spring member.

The details of one or more implementations are set forth in the accompanying drawings and the description below. Other features will be apparent from the description and drawings, and from the claims.

DETAILED DESCRIPTION

Specific embodiments of the invention are here described in detail, below. In the following description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named the elements. For example, a first element is distinct from a second element, and the first element may encompass more than one element and succeed (or precede) the second element in an ordering of elements.

The external pivot mechanisms of head-worn audio devices often suffer from problems such as pinching or pulling user hair; manufacturing challenges with respect to colors, materials, and finishing; providing an ingress for elements that may damage the components of the head-worn audio device; and being prone to mechanical breakage due to mishandling. In other words, not only do such external pivots present challenges to the designers and manufacturers of head-worn audio devices, but external pivots also may cause user discomfort and frustration.

In general, embodiments of the invention provide a seamless pivot for head-worn audio devices. The inventive pivot described herein includes a concealed spring member configured to facilitate user rotation of a head-worn audio device's earcups. The inventive pivot simplifies design and manufacturing by obviating design efforts associated with the aesthetics (e.g., color, finishing, etc.) of externally visible mechanical sub-assemblies. Further, by concealing the inventive pivot within the head-worn audio device, a user's hair cannot be caught in the pivot, thereby enhancing user comfort. Finally, by concealing the inventive pivot within the head-worn audio device, the ingress of debris into areas of mechanical and/or electrical sensitivity is reduced. In other words, the seamless pivot described herein may simplify the design and manufacture of a head-worn audio device employing the same, while increasing the durability of the device and improving user comfort.

Figure 1A:
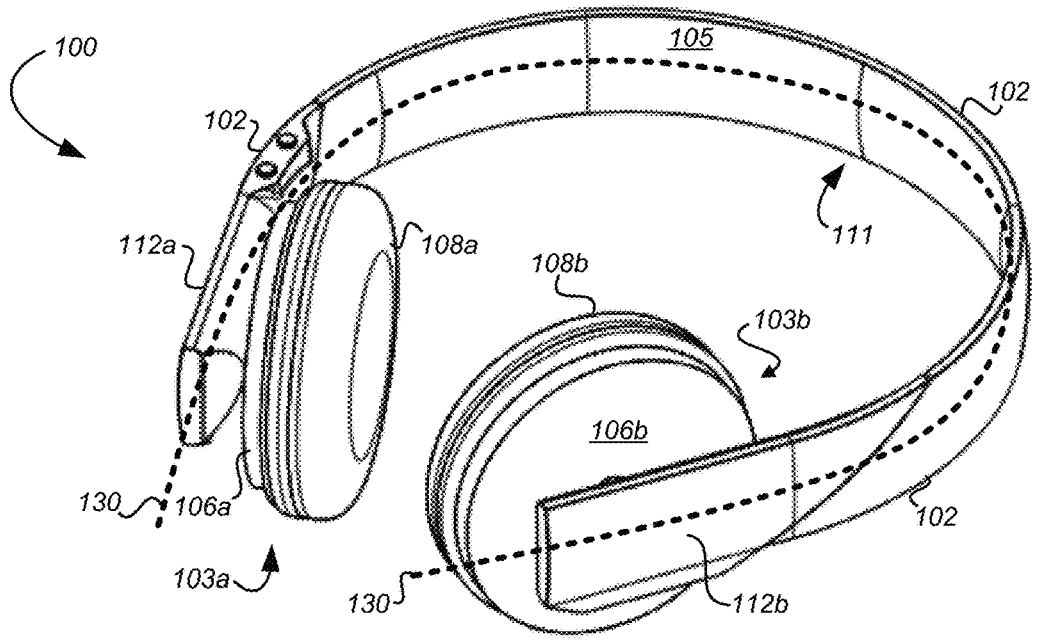
FIGS. 1A and 1B are perspective views of a head-worn audio device with seamless pivots, in accordance with one or more embodiments of the invention.
Figure 1B:
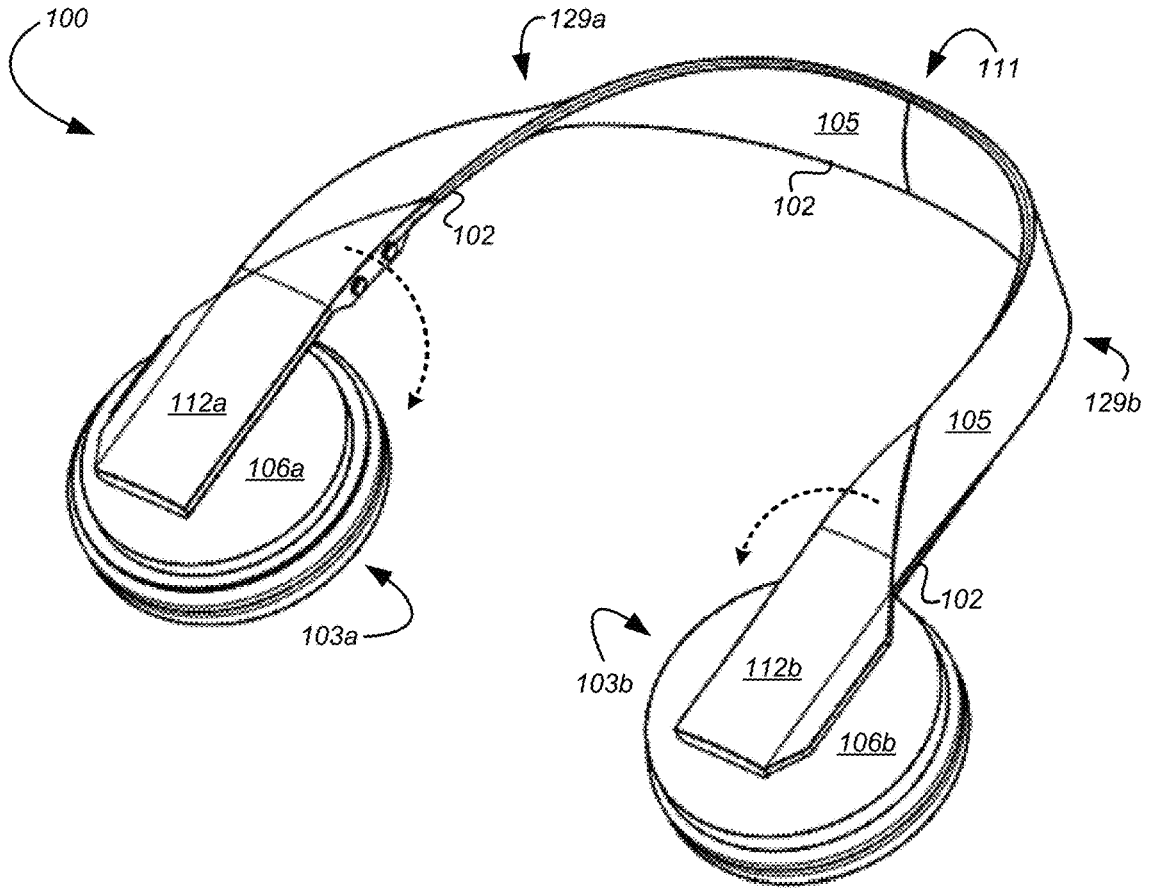

FIGS. 1A and 1B show a head-worn audio device 100 with seamless pivots, according to one or more embodiments. Although the elements of the head-worn audio device 100 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 1A and 1B may be omitted, repeated, and/or substituted. Accordingly, various embodiments may lack one or more of the features shown. For this reason, embodiments of the invention should not be considered limited to the specific arrangements of elements shown in FIGS. 1A and 1B.

As illustrated in FIGS. 1A and 1B, a head-worn audio device 100 includes a headband 102 that extends between a first ear sub-assembly 103*a* (i.e., right ear sub-assembly) and a second ear sub-assembly 103*b* (i.e., left ear sub-assembly). The headband 102 includes a curved or arched band 105 to which the first ear sub-assembly 103*a* is attached via a first headband tube 112*a* (i.e., right headband tube) of the headband 102, and the second ear sub-assembly 103*b* is attached via a second headband tube 112*b* (i.e., left headband tube) of the headband 102. In other words, the first headband tube 112*a* interconnects the first earcup 106*a* with the headband 102, and the second headband tube 112*b* interconnects the second earcup 106*b* with the headband 102. The headband tubes 112 are generally rigid bodies, and transfer a user-applied force, such as a twist or rotation applied at the associated ear sub-assembly 103 and/or the headband tube 112 itself, to a more flexible region of the headband 102, as described below.

As illustrated in FIGS. 1A and 1B, the external surfaces of the of the headband tubes 112 and the arched band 105 of the headband 102 may be generally contiguous. Further, as illustrated in FIGS. 1A and 1B, the headband tubes 112 and the arched band 105 of the headband 102 may have the same general width and/or height. Because of these design choices, and because the moving parts of any earcup pivot are hidden internally, the head-worn audio device 100 may present an overall sleek and unitary aesthetic.

In one or more embodiments, cables traveling along and/or within the headband 102 may enable communication (e.g., audio signals, digital communications, etc.) between electronic and/or acoustic componentry housed in the separate ear sub-assemblies 103. The first ear sub-assembly 103*a* is shown to include a first earcup 106*a* (i.e., right earcup) coupled with a first ear cushion 108*a* (i.e., right ear cushion). Similarly, the second ear sub-assembly 103*b* includes a second earcup 106*b* (i.e., left earcup) coupled with a second ear cushion 108*b* (i.e., left ear cushion). Each of the earcups 106 may be attached to, or integrally formed with, an internal surface of a corresponding headband tube 112. Each of the earcups 106 may house a speaker for generating audio signals that are perceptible to a user wearing the head-worn audio device 100. As an option, the head-worn audio device 100 may include one or more microphones for receiving speech that is spoken by the wearing user (i.e., a headset). Although each of the head-worn audio devices shown and described in reference to FIGS. 1-4 are binaural devices, it is contemplated that the concepts described herein may be equally applicable to monaural head-worn audio devices, such as monaural headsets that include a single ear-subassembly (i.e., single earcup, single ear cushion, etc.) and temple-pad, with a headband extending therebetween.

In one or more embodiments, the head-worn audio device 100 comprises a set of over-the-ear (e.g., circumaural, etc.) headphones. In one or more embodiments, the head-worn audio device 100 comprises a set of on-the-ear (e.g., supraaural, etc.) headphones. Accordingly, as described herein, the ear cushions 108 may include any suitable interface between the earcups 106 and a wearing user's head and ears. In one or more embodiments, the ear cushions 108 provide an acoustic seal that improves the listening experience of the wearing user. As an option, the ear cushions 108 may include a foam (e.g., urethane foam, etc.), gel, leather, and/or leatherette material to ensure durability and resilience of the head-worn audio device 100, while providing comfort to the wearing user. In one or more embodiments, the head-worn audio device 100 may include, such as within one of the ear sub-assemblies 103, for example, a wireless transceiver. The wireless transceiver may include, for example, a Bluetooth, Wi-Fi, Digital Enhanced Cordless Telecommunications, or Digital European Cordless Telecommunications transceiver.

The headband 102 may be configured to rest on top of the head of a user wearing the head-worn audio device 100, such that the head-worn audio device 100 is entirely supported by the user's head with the first ear sub-assembly 103*a* and the second ear sub-assembly 103*b* adjacent to the user's right and left ears. Approximately midway between the first headband tube 112*a* and the second headband tube 112*b* is an apex 111 of the headband 102. When the head-worn audio device 100 is worn by a user, the apex 111 of the headband 102 may rest upon the user's head. In one or more embodiments, at least a portion of the headband 102 may include a flexible material. Referring to FIG. 1B, the arched band 105 of the headband 102 is shown to include a first flexible region 129*a* between the apex 111 and the first headband tube 112*a*, and a second flexible region 129*b* between the apex 111 and the second headband tube 112*b*. Each flexible region 129 may include, for example, an elastomeric element and/or fabric material. The flexible regions 129 of the headband 102 may conceal, at least in part, a spring member internal to the headband 102, as described below. As an option, the headband 102 may include regions of varying flexibility. In other words, the flexibility and rigidity of the headband 102 may vary along the length of the headband 102 between a headband tube 112 and the apex 111.

In one or more embodiments, the headband 102 may include a rigid metal or plastic member that provides the headband 102 with a clamping pressure for holding the head-worn audio device 100 in place on a user's head. For example, a spring member may be disposed within the headband 102, substantially along a longitudinal axis 130 of the headband 102.

As described herein, each headband tube 112 includes a terminal portion of the headband 102 that may rotate about the longitudinal axis 130 of the headband 102 while the apex 111 remains in a substantially fixed position relative to the longitudinal axis 130. Rotation of a headband tube 112 about the longitudinal axis 130 may be enabled, at least in part, by way of the corresponding flexible region 129 of the headband 102. For example, the pliability of the first flexible region 129*a* may permit rotation of the first headband tube 112*a*, and the pliability of the second flexible region 129*b* may permit rotation of the second headband tube 112*b*. As depicted in FIG. 1B, and relative to FIG. 1A, the first headband tube 112*a* and the second headband tube 112*b*, as well as the respectively coupled ear sub-assemblies 103, have each been rotated approximately 90 degrees about the longitudinal axis 130 of the headband 102. The rotation of the headband tubes 112 is enabled by an internal seamless pivot, described in more detail below. When the ear sub-assemblies 103 have been rotated into the position illustrated by FIG. 1B, the head-worn audio device 100 may achieve a flatter conformation than depicted in FIG. 1A. In the folded or flat conformation depicted in FIG. 1B, the head-worn audio device 100 may be more easily stowed for storage and transport as compared to the in-use conformation of FIG. 1A. Also, when in the folded or flat conformation depicted in FIG. 1B, the head-worn audio device 100 may be worn around a user's neck, with the ear cushions 108 resting comfortably on the user's chest. In one or more embodiments, and as described below, the head-worn audio device 100 may lock into the folded or flat conformation of FIG. 1B to facilitate storage and transport.

The head-worn audio device 100 of FIGS. 1A and 1B may offer greater durability and comfort than head-worn audio devices that include an external pivot mechanism. Further, because the pivoting mechanism of the head-worn audio device 100 is internal and hidden from view, the components of the internal pivot may be easier to manufacture than external pivots that require special consideration for purposes of color, material, and finish.

Figure 2A:
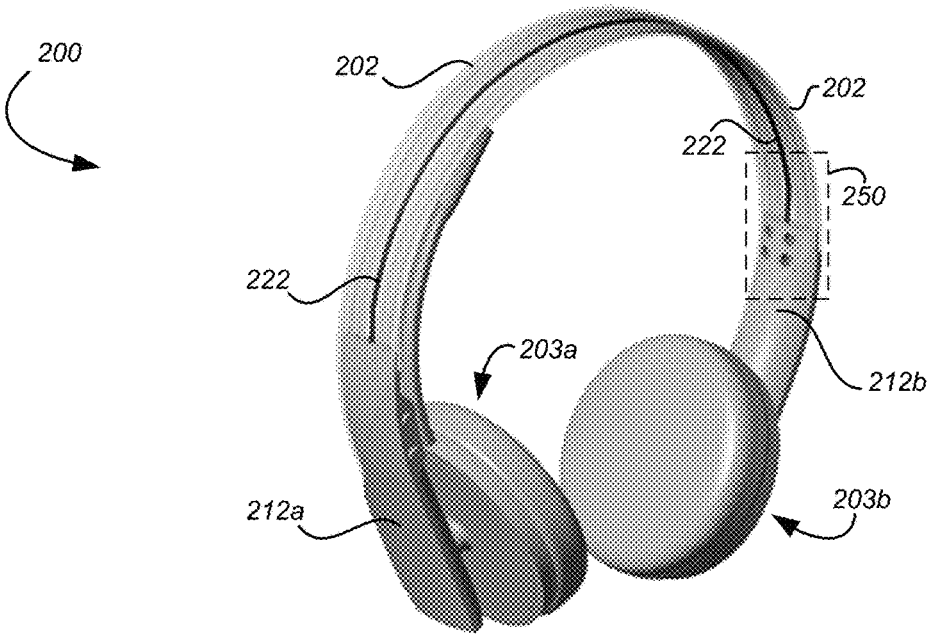
FIGS. 2A and 2B are perspective views of a head-worn audio device with seamless pivots, in accordance with one or more embodiments of the invention.
Figure 2B:
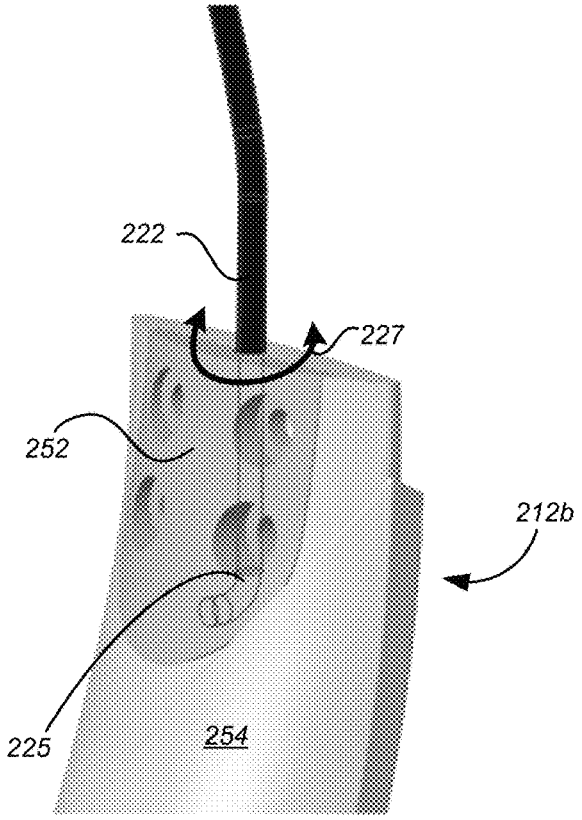

FIGS. 2A and 2B show perspective views of a head-worn audio device 200 according to one or more embodiments. Although the elements of the head-worn audio device 200 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 2A and 2B may be omitted, repeated, and/or substituted. Accordingly, various embodiments may lack one or more of the features shown. For this reason, embodiments of the invention should not be considered limited to the specific arrangements of elements shown in FIGS. 2A and 2B.

As depicted in FIGS. 2A and 2B, the head-worn audio device 200 includes a headband 202 that extends between a first ear sub-assembly 203*a* (i.e., right ear sub-assembly) and a second ear sub-assembly 203*b* (i.e., left ear sub-assembly). The headband 202 includes a curved or arched band to which the first ear sub-assembly 203*a* is attached via a first headband tube 212*a* (i.e., right headband tube) of the headband 202, and the second ear sub-assembly 203*b* is attached via a second headband tube 212*b* (i.e., left headband tube) of the headband 202. The head-worn audio device 200 of FIGS. 2A and 2B may be substantially identical to the head-worn audio device 100 described above in reference to FIGS. 1A and 1B. Portions of the headband 202 have been rendered as transparent for purposes of clarity.

Installed within the headband 202 is a spring member 222. As depicted in FIGS. 2A and 2B, the spring member 222 is shown as a generally U-shaped, cylindrical wire (i.e., having a uniform circular cross-sectional profile), with a first end of the spring member 222 terminating within the first headband tube 212*a* and a second end of the spring member 222 terminating within the second headband tube 212*b* of the headband 202. As described in more detail below, the spring member 222 may be used as a pivot, about which each headband tube 212 rotates. Accordingly, for purposes of simplicity, the spring member 222 is shown and described herein to have a circular cross-sectional profile along its entire length. However, it is contemplated that a spring member may have any suitable shape, and, in one or more embodiments, the spring member may include regions of other geometries. For example, at least a portion of a spring member may be flat or ribbon-shaped (i.e., having a thickness in a first dimension that is greater than its thickness in a second dimension), rather than round. For a spring member of a given size (e.g., length, height, etc.), a spring member including a flat region may store more clamping force than an entirely cylindrical spring member. In such embodiments, the spring member may have a circular cross-sectional profile along portions or segments of the spring member about which the headband tubes 212 are configured to rotate. In other words, in embodiments where a portion of a spring member includes a non-uniform and/or non-cylindrical cross-sectional profile, a region of the spring member about which a headband tube rotates may be cylindrical to facilitate rotation (i.e., along a path 227), as described below.

Referring still to FIGS. 2A and 2B, the spring member 222 may provide the headband 202 with at least some of the clamping pressure that holds the head-worn audio device 200 on the head of a user (i.e., applies inward pressure at the user's ears). For example, the length of the spring member 222, distance between ends of the spring member 222, and the gauge of the spring member 222 may be selected to ensure that the head-worn audio device 200 is secured to a user's head while not causing user discomfort. The spring member 222 may comprise a single, unitary component. As an option, the spring member 222 may be entirely metal (e.g., a steel material, etc.), and/or a polymer material. Of course, however, the spring member 222 may comprise any suitable material.

In one or more embodiments, the headband 202 may include an internal channel within which the spring member 222 is inserted. Although not shown in FIGS. 2A and 2B, it is understood that the headband 202 may include one or more additional internal channels through which cables (e.g., power, audio, etc.) may extend between the ear sub-assemblies 203.

FIG. 2B shows a more detailed close-up view of a region 250 of the head-worn audio device 200, as indicated in FIG. 2A. In FIG. 2B, portions of the headband 202 have been hidden for clarity. It is understood that the various elements and features of the second headband tube 212*b*, described below in the context of FIG. 2B, may be equally applicable to the first headband tube 212*a*, the description of which has been omitted for purposes of brevity.

As shown in FIG. 2B, an end 225 of the spring member 222 is captured by the headband tube 212*b*. More specifically, the headband tube 212*b* is shown to include a cover 252 that attaches to a headband tube body 254 in a manner that securely encircles an end 225 of the spring member 222. In one or more embodiments, and as depicted in FIG. 2B, the cover 252 may be a complementary chip or plate that interfaces with a void on the headband tube body 254 to conceal the end 225 of the spring member 222 within the headband tube 212*b*. Accordingly, as depicted in FIG. 2B, the spring member 222 is securely held between the cover 252 and the headband tube body 254 in manner that allows the headband tube 212*b* to rotate about the spring member 222 along a path 227.

Although FIGS. 2A and 2B show the end 225 of the spring member 222 being secured between the cover 252 and the headband tube body 254, it is contemplated that the end 225 of the spring member 222 may be secured in the headband tube 212*b* in any manner that permits the headband tube 212*b* to pivot around the spring member 222. For example, in one or more embodiments, the headband tube 212*b* may comprise two substantially equally sized rigid members that interlock to enclose the end 225 of the spring member 222. As another example, the headband tube 212*b* may comprise a clamshell enclosure that folds onto the end 225 of the spring member 222. In one or more embodiments, the end 225 of the spring member 222 may include a groove for retaining a C-clip. The C-clip may be installed into a slot within the headband tube 212*b* in a manner that helps retain the end 225 of the spring member 222 within the headband tube 212*b*, and reduce non-rotational movement of the spring member 222 relative to the headband tube 212*b*. As an option, use of a C-clip may allow the spring member to terminate without any bend (i.e., without a J-shaped bend).

Figure 3A:
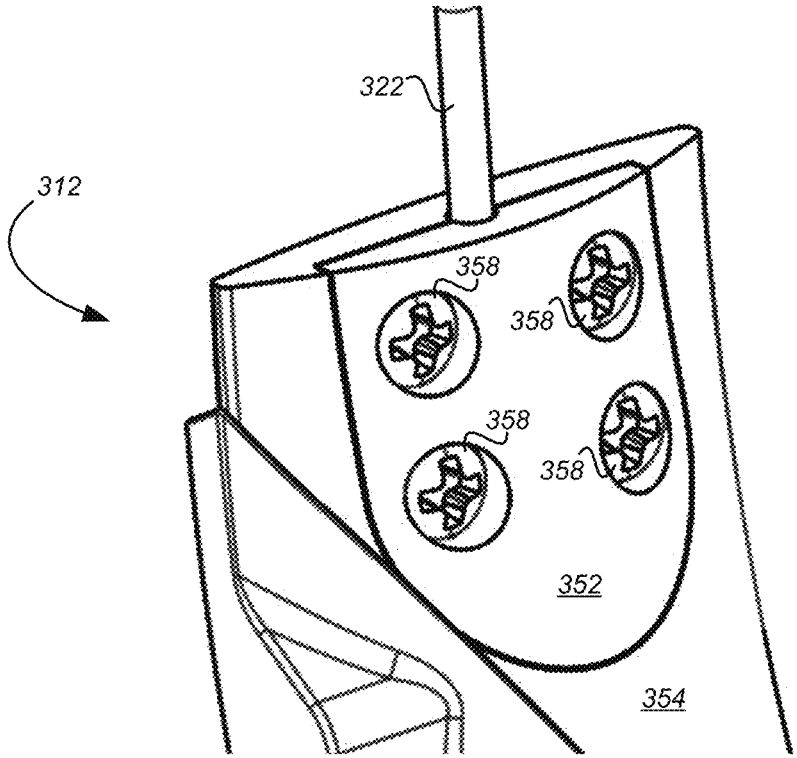
FIGS. 3A, 3B, and 3C are perspective views depicting the elements of a seamless pivot for head-worn audio devices, in accordance with one or more embodiments of the invention.
Figure 3B:
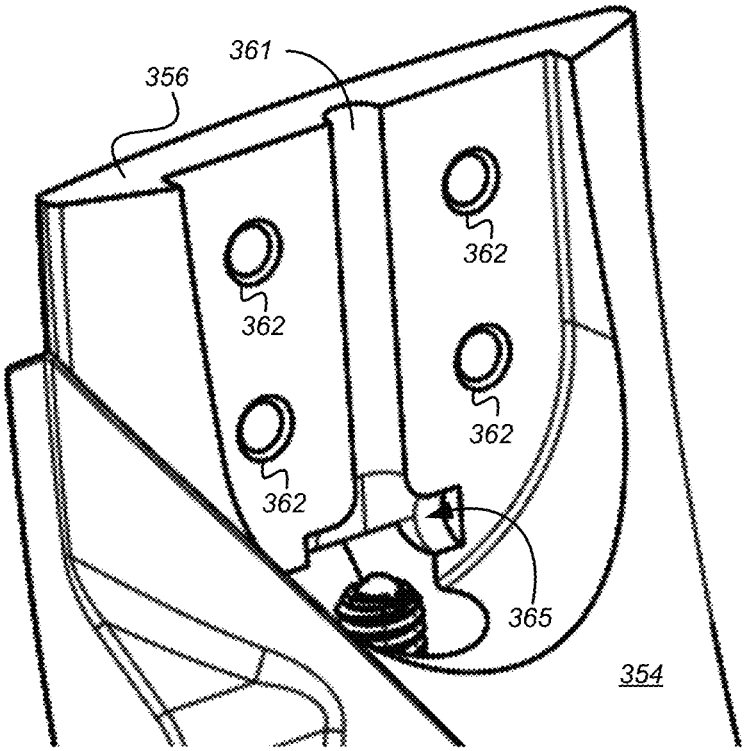
Figure 3C:
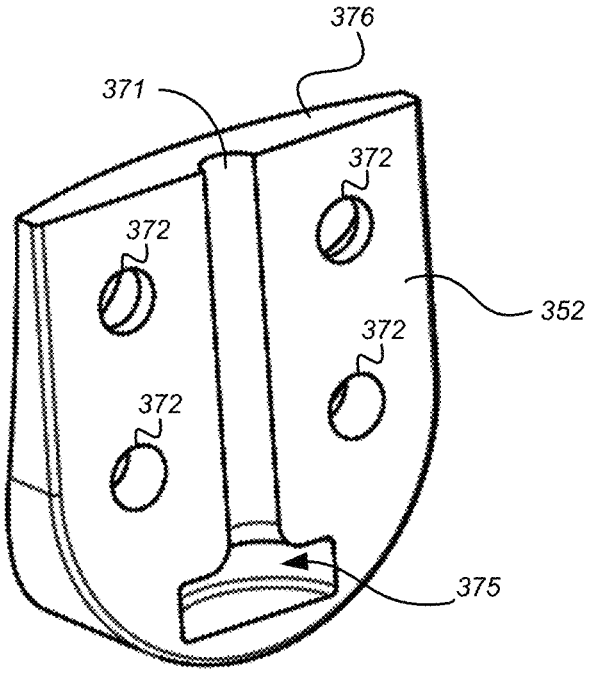

FIGS. 3A, 3B, and 3C show perspective views of a headband tube 312 of a head-worn audio device, according to one or more embodiments. Although the elements of the headband tube 312 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 3A, 3B, and 3C may be omitted, repeated, and/or substituted. Accordingly, various embodiments may lack one or more of the features shown. For this reason, embodiments of the invention should not be considered limited to the specific arrangements of elements shown in FIGS. 3A, 3B, and 3C.

Referring now to FIG. 3A, the headband tube 312 is shown to include a cover 352 and a headband tube body 354. The headband tube 312 shown in FIG. 3A may be included in a head-worn audio device, as shown and described above. The cover 352 securely interfaces with the headband tube body 354 to encircle an end of a spring member 322. Moreover, as described below, the headband tube 312 is capable of rotating about the end of the spring member 322, thereby providing a head-worn audio device with a hidden pivot about which an earcup of the head-worn audio device may rotate. As illustrated in FIG. 3A, the cover 352 may be fastened to the headband tube body 354 using one or more screws 358. However, it is contemplated that in one or more embodiments other suitable fastening mechanisms may be used. For example, the cover 352 may be attached to the headband tube body 354 by way of an adhesive and/or snap-fit tabs. As another example, the cover 352 may be fused or welded to the headband tube body 354. Although not shown in FIG. 3A for purposes of clarity, it is understood that the spring member 322 may be sheathed in a flexible headband material that extends from the headband tube 312 along the spring member 322, and that allows the headband tube 312 to rotate about the enclosed portion of the spring member 322.

FIG. 3B shows a detailed perspective view of the headband tube body 354. As shown in FIG. 3B, the headband tube body 354 includes a groove 361 extending from a top surface 356 of the headband tube body 354 to a detent 365. The detent 365 is shown to be a flared void for accommodating rotation of a spring member (not shown) relative to the headband tube 312. The spring member may terminate with a J-shaped bend. The detent 365 may allow the spring member to lock into one or more positions (e.g., a folded flat conformation, etc.). Also, the headband tube body 354 is shown to include one or more screw holes 362, which may be used for fastening the cover 352 to the headband tube body 354.

FIG. 3C shows a detailed perspective view of an inner surface of the cover 352. As shown in FIG. 3C, cover 352 includes a groove 371 extending from a top surface 376 of the cover 352 to a cavity 375. The cavity 375 is illustrated as a semi-cylindrical opening in the cover 352 through which an end of a spring member terminating with a bend (e.g., a J-shaped, etc.) may travel when the spring member rotates relative to the headband tube 312. Also, the cover 352 is shown to include one or more screw holes 372. When the headband tube body 354 and cover 352 are assembled with a spring member 322 therebetween, as shown in FIG. 3A, the groove 361 of the headband tube body 354 and the groove 371 of the cover 352 are aligned to provide a cylindrical channel within which the spring member 322 is captured. In such an assembly, the screw holes 362 of the headband tube body 354 may be aligned with the screw holes 372 of the cover 352, such that the cover 352 may be affixed to the headband tube body 354 by way of the screws 358. Further, in such an assembly the detent 365 and the cavity 375 may be communicatively aligned such that the travel of an end of the spring member 322 sweeping through the cavity 375 is limited, at least in part, by the detent 365. More specifically, an end of the spring member 322 may travel along a path that is parallel to the semi-cylindrical wall of the cavity 375 as the headband tube 312 rotates about the spring member 322, until further rotation is prevented by the detent 365. The cavity 375 and the detent 365 may allow the headband tube 312 to rotate between approximately 90-180 degrees relative to the spring member 322. Moreover, the cavity 375 may be configured to allow some float of the headband tube 312 relative to the spring member 322. In particular, a height of the cavity 375 may allow for some movement of the headband tube 312 along the spring member 322, in addition to rotation about the spring member 322.

Figure 4C:
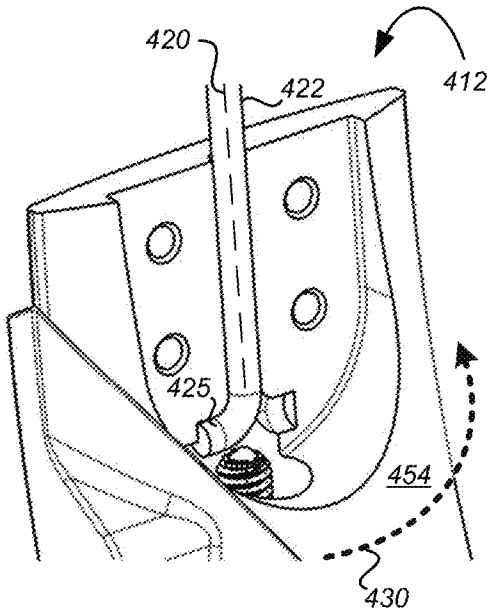
FIGS. 4A, 4B, and 4C show a sequence views of an exemplary rotation of a seamless pivot for head-worn audio devices, in accordance with one or more embodiments of the invention.
Figure 4B:
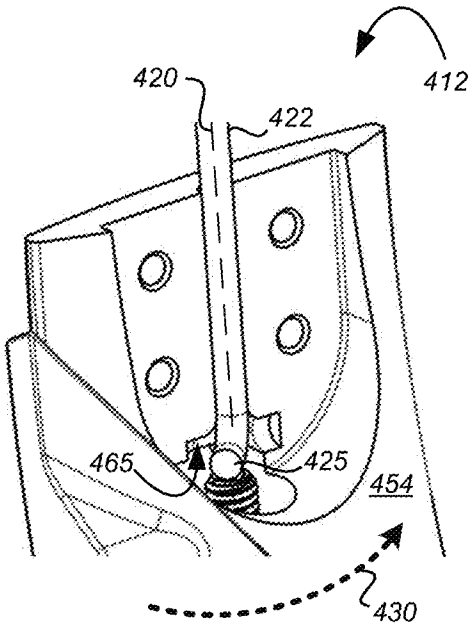
Figure 4A:
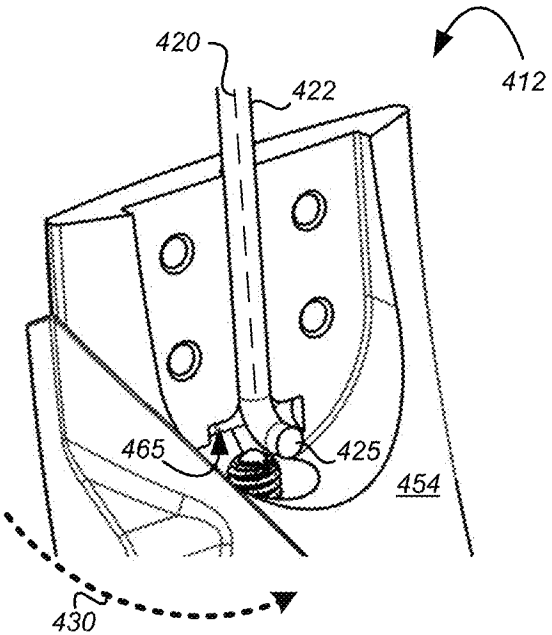

FIGS. 4A-4C show a sequence of views of a headband tube 412 of a head-worn audio device rotating about a spring member, according to one or more embodiments. Although the elements of the headband tube 412 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 4A-4C may be omitted, repeated, and/or substituted. Accordingly, various embodiments may lack one or more of the features shown. For this reason, embodiments of the invention should not be considered limited to the specific arrangements of elements shown in FIGS. 4A-4C.

The cutaway perspective views of FIGS. 4A-4C illustrate a rotation of a headband tube 412 relative to a spring member 422. The headband tube 412 includes a headband tube body 454, as described above. For purposes of clarity, the headband tube 412 is shown without a cover (e.g., a cover 252, 352, etc.) installed. Also, for purposes of clarity, the headband tube 412 is shown without an arched band, that would conceal the spring member 422, extending therefrom. In this way, FIGS. 4A-4C clearly illustrate the movement of the headband tube 412 relative to the spring member 422 as a head-worn audio device transitions (i.e., FIG. 4B) from a state in which it can be worn on a user's head (i.e., FIG. 4A) to a state in which it is generally folded flat (i.e., FIG. 4C). Accordingly, as the headband tube 412 rotates along a path 430, and about an axis 420 of the spring member 422, the end 425 of the spring member 422 rotates into a detent 465. The detent 465 may be configured to capture and hold an end 425 of the spring member 422 once further travel of the end 425 of the spring member 422 is precluded by the detent 465. For example, the detent 465 may include a nubbin or other surface feature to prevent rotation, without sufficient user-applied force, of the headband tube 412 relative to the spring member 422 to cause the end 425 of the spring member 422 to exit the detent 465, and return the headband tube 412 to the arrangement shown in FIG. 4A.

FIGS. 5A, 5B, 5C, and 5D show perspective views of a headband tube 512, and the components thereof, of a head-worn audio device, according to one or more embodiments. FIGS. 5E-5G show a sequence of views of the headband tube 512 rotating about a spring member, according to one or more embodiments. Although the elements of the headband tube 512 are presented in one arrangement, other embodiments may feature other arrangements, and other configurations may be used without departing from the scope of the invention. For example, various elements may be combined to create a single element. As another example, the functionality performed by a single element may be performed by two or more elements. In one or more embodiments of the invention, one or more of the elements shown in FIGS. 5A-5G may be omitted, repeated, and/or substituted. Accordingly, various embodiments may lack one or more of the features shown. For this reason, embodiments of the invention should not be considered limited to the specific arrangements of elements shown in FIGS. 5A-5G.

Figure 5A:
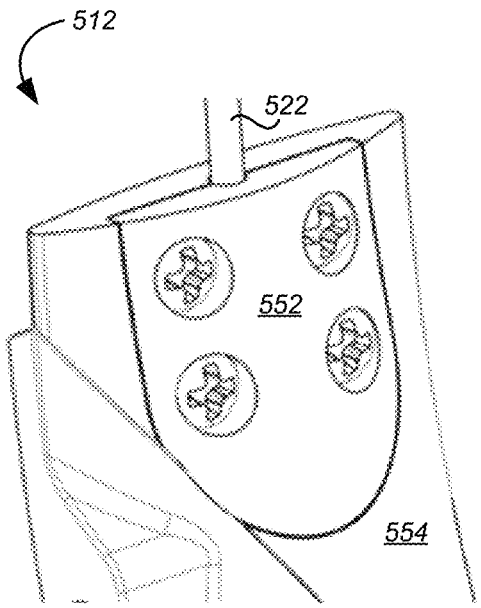
FIGS. 5A, 5B, 5C, and 5D are perspective views depicting the elements of a seamless pivot for head-worn audio devices, in accordance with one or more embodiments of the invention.

Referring now to FIG. 5A, the headband tube 512 is shown to include a cover 552 and a headband tube body 554. The headband tube 512 shown in FIG. 5A may be included in a head-worn audio device, as shown and described above. The cover 552 securely interfaces with the headband tube body 554 to encircle an end of a spring member 522. Moreover, as described below, the headband tube 512 is capable of rotating about the end of the spring member 522, thereby providing a head-worn audio device with a hidden pivot about which an earcup of the head-worn audio device may rotate. As illustrated in FIG. 5A, the cover 552 may be fastened to the headband tube body 554 using one or more screws. However, it is contemplated that in one or more embodiments other suitable fastening mechanisms may be used. Although not shown in FIG. 5A for the purpose of clarity, it is understood that the spring member 522 may be sheathed in a flexible headband material that extends from the headband tube 512 along the spring member 522, and that allows the headband tube 512 to rotate about the enclosed portion of the spring member 522.

Figure 5B:
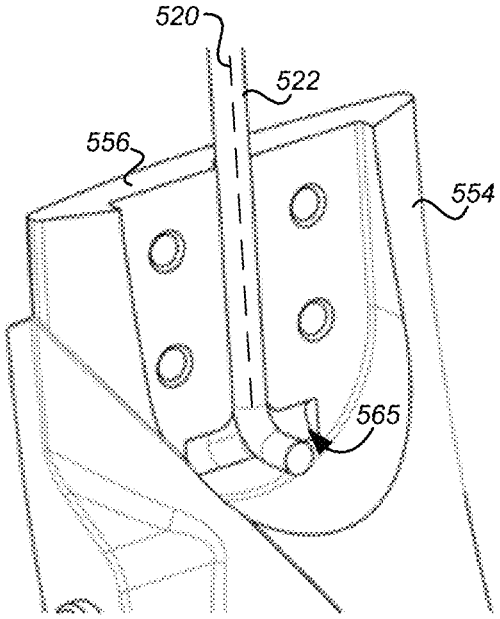

FIG. 5B shows a detailed perspective view of the headband tube body 554. As shown in FIG. 5B, the spring member 522 rests in a groove of the headband tube body 554. The groove extends from a top surface 556 of the headband tube body 554 to a detent 565 of the headband tube body 554. The detent 565 is shown to be a flared void for accommodating rotation of the headband tube 512 about an axis 520 of the spring member 522, which terminates with a J-shaped bend.

Figure 5C:
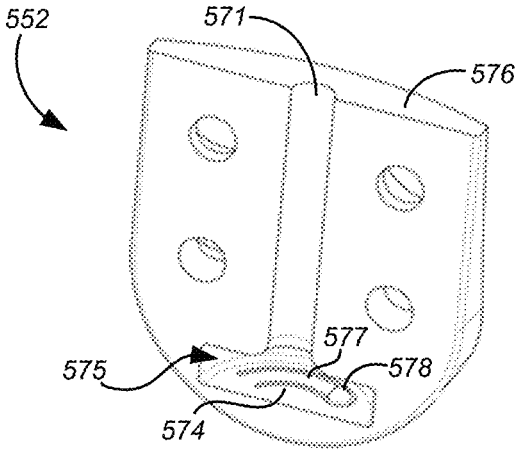
Figure 5D:
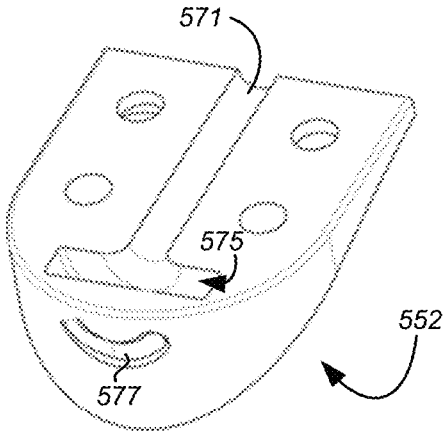
Figure 5G:
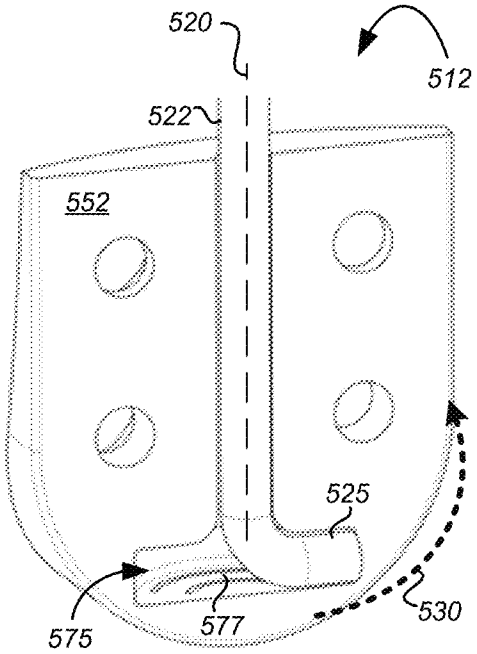
FIGS. 5E, 5F, and 5G show a sequence views of an exemplary rotation of a seamless pivot for head-worn audio devices, in accordance with one or more embodiments of the invention.
Figure 5F:
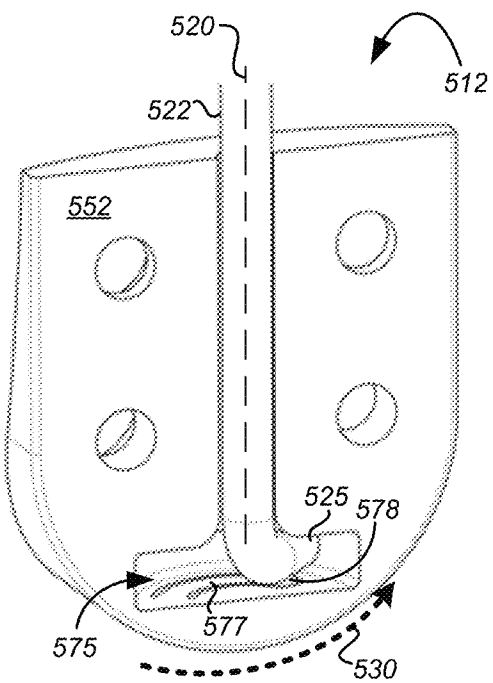
Figure 5E:
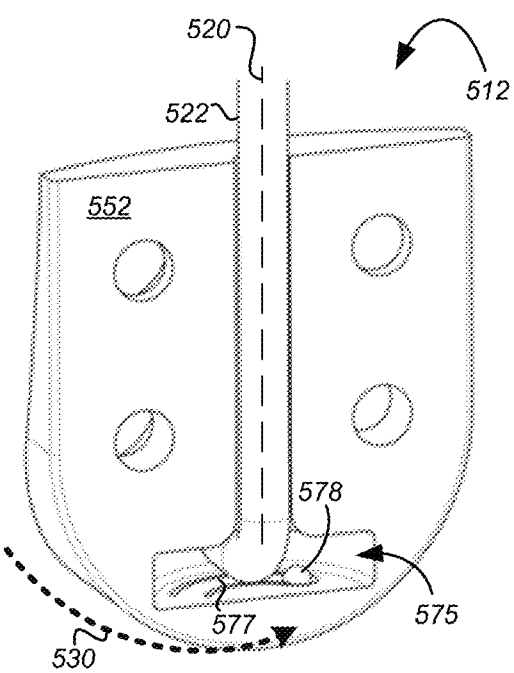

FIGS. 5C and 5D show detailed perspective views of an inner surface of the cover 552. As shown in FIG. 5C, the cover 552 includes a groove 571 extending from a top surface 576 of the cover 552 to a cavity 575. The cavity 575 is illustrated as a semi-cylindrical opening in the cover 552 through which the end of the spring member 522 may travel when the spring member 522 rotates relative to the headband tube 512. A bottom surface 574 of the cavity 575 is shown to include a beam spring 577. The beam spring 577 may be vertically displaced independent of the remainder of the bottom surface 574 of the cavity 575. At an end of the beam spring 577 is a ball detent 578. The ball detent 578 is shown protruding into the cavity 575, such that the ball detent 578 may briefly obstruct passage of an end of the spring member 522 as it moves over the ball detent 578 when the headband tube 512 is rotated about the spring member 522. In one or more embodiments, the headband tube body 554 and/or the cover 552 may comprise a low friction and/or high wear-resistant material. For example, the headband tube body 554 and/or the cover 552 may comprise a thermoplastic material, such as a nylon or Delrin polymer. Such materials may withstand repeated flexing cycles of the beam spring 577, as the end of the spring member 522 moves over the ball detent 578. Further, such materials may resist wearing due to the end of the spring member 522 repeatedly rubbing against the ball detent 578.

When the headband tube body 554 and cover 552 are assembled with the spring member 522 therebetween, as shown in FIG. 5A, the groove of the headband tube body 554 and the groove 571 of the cover 552 are aligned to provide a cylindrical channel within which the spring member 522 is captured. Further, in such an assembly the detent 565 and the cavity 575 may be communicatively aligned such that the travel of an end of the spring member 522 sweeping through the cavity 575 is limited, at least in part, by the detent 565. More specifically, an end of the spring member 522 may travel along a path that is parallel to the semi-cylindrical wall of the cavity 575 as the headband tube 512 rotates about the spring member 522, until further rotation is prevented by the detent 565. The cavity 575 and the detent 565 may allow the headband tube 512 to rotate between approximately 90-180 degrees relative to the spring member 522.

The cutaway perspective views of the inside of the cover 552 of FIGS. 5E-5G illustrate a rotation of the headband tube 512 relative to the spring member 522. As described above, the headband tube 512 includes a headband tube body 554 and a cover 552. However, to clearly illustrate the interaction of the spring member 522 and the ball detent 578, the headband tube 512 is shown without a headband tube body (i.e., the headband tube body 554) installed. In this way, FIGS. 5E-5G clearly illustrate the movement of the headband tube 512 relative to the spring member 522 as a head-worn audio device transitions (i.e., FIG. 5F) from a state in which it can be worn on a user's head (i.e., FIG. 5E) to a state in which it is generally folded flat (i.e., FIG. 5G). When in the state in which the head-worn audio device can be worn on a user's head (i.e., FIG. 5E) and the state in which the head-worn audio device is generally folded flat (i.e., FIG. 5G), the ball detent 578 may protrude into the cavity 575. Accordingly, as the headband tube 512 rotates along a path 530, and about an axis 520 of the spring member 522, the end 525 of the spring member 522 encounters the ball detent 578. For the end 525 of the spring member 522 to continue past the ball detent 578, sufficient twisting force must be applied to depress the ball detent 578 and flex the beam spring 577. As shown in FIG. 5F, the ball detent 578 is temporarily depressed as the end 525 of the spring member 522 passes over the ball detent 578. In this way, the ball detent 578 may preclude rotation of the headband tube 512 about the spring member 522 unless a threshold level of rotational force is applied, thereby ensuring that the head-worn audio device remains folded flat or ready to be worn, as chosen by a user.

The various embodiments described above provide mechanisms for seamless internal pivots for head-worn audio devices that enable folding of the devices for storage and travel when not in use, while increasing device resiliency and user comfort, and simplifying manufacture. Several implementations have been described. Nevertheless, various modifications may be made without departing from the scope of the disclosure. Accordingly, other implementations are within the scope of the following claims.

What is claimed is:

1. A head-worn audio device, comprising:
a first earcup;
a second earcup; and
a headband extending between the first earcup and the second earcup, the headband including:
a spring member disposed along a longitudinal axis of the headband, the spring member having a first end and a second end,
a first headband tube coupled to the first earcup and the first end of the spring member,
a second headband tube coupled to the second earcup and the second end of the spring member, and
an arched band enclosing the spring member between the first headband tube and the second headband tube, the arched band comprising at least one flexible region extending along the longitudinal axis of the headband,
wherein the first headband tube and the second headband tube are contiguous with the arched band, and
wherein the first headband tube is configured to rotate around the first end of the spring member and the second headband tube is configured to rotate around the second end of the spring member, the rotating causing a torsion across the at least one flexible region of the arched band enclosing the spring member.

2. The head-worn audio device of claim 1, wherein the spring member comprises a steel material.

3. The head-worn audio device of claim 1, wherein the spring member comprises a U-shaped, cylindrical wire having a substantially uniform circular cross-sectional area.

4. The head-worn audio device of claim 3, wherein the first end of the spring member includes a first J-shaped bend, and the second end of the spring member includes a second J-shaped bend.

5. The head-worn audio device of claim 4, wherein the first headband tube includes a first detent configured to limit the rotation of the first headband tube around the first end of the spring member, and the second headband tube includes a second detent configured to limit the rotation of the second headband tube around the second end of the spring member.

6. The head-worn audio device of claim 1, the headband including:
an apex approximately midway between the first headband tube and the second headband tube,
wherein the at least one flexible region is between at least one of the headband tubes and the apex.

7. The head-worn audio device of claim 6, wherein the headband includes a first flexible region between the first headband tube and the apex, and a second flexible region between the second headband tube and the apex.

8. The head-worn audio device of claim 6, wherein the at least one flexible region of the headband includes an elastomeric element.

9. The head-worn audio device of claim 6, wherein the at least one flexible region of the headband includes a fabric material.

10. A head-worn audio device, comprising:
an earcup; and
a headband extending from the earcup, the headband including:
a spring member disposed along a longitudinal axis of the headband, the spring member having a first end and a second end, and
a headband tube coupled to the earcup and the first end of the spring member,
a temple-pad coupled to the second end of the spring member, and
an arched band enclosing the spring member between the headband tube and the temple-pad, the arched band comprising at least one flexible region extending along the longitudinal axis of the headband,
wherein the headband tube and the temple-pad are contiguous with the arched band, and
wherein the headband tube is configured to rotate around the first end of the spring member.

11. The head-worn audio device of claim 10, wherein the spring member comprises a steel material.

12. The head-worn audio device of claim 10, wherein the first end of the spring member includes a J-shaped bend.

13. The head-worn audio device of claim 10, wherein the headband tube includes a detent configured to limit the rotation of the headband tube around the first end of the spring member.

* * * * *